US010731891B2

(12) United States Patent
Khalil

(10) Patent No.: US 10,731,891 B2
(45) Date of Patent: Aug. 4, 2020

(54) SOFFIT VENT

(71) Applicant: Anneliese Khalil, Philadelphia, PA (US)

(72) Inventor: Anneliese Khalil, Philadelphia, PA (US)

( * ) Notice: Subject to any disclaimer, the term of this patent is extended or adjusted under 35 U.S.C. 154(b) by 126 days.

(21) Appl. No.: 14/739,916

(22) Filed: Jun. 15, 2015

(65) Prior Publication Data

US 2015/0362203 A1 Dec. 17, 2015

Related U.S. Application Data

(60) Provisional application No. 62/011,748, filed on Jun. 13, 2014.

(51) Int. Cl.
*F24F 13/02* (2006.01)
*F24F 7/06* (2006.01)
*F24F 7/00* (2006.01)

(52) U.S. Cl.
CPC ..... *F24F 13/02* (2013.01); *F24F 7/06* (2013.01); *F24F 2007/001* (2013.01)

(58) Field of Classification Search
CPC ..... F24F 13/02; F24F 7/06; F24F 2007/001; F24F 2007/002; F24F 7/065
USPC ..... 454/354, 364, 365, 366, 367
See application file for complete search history.

(56) References Cited

U.S. PATENT DOCUMENTS 3,051,071 A 4/1958 Leigh
5,167,578 A * 12/1992 Legault ..... F24F 7/00 454/350
5,934,362 A 8/1999 Barker, II
6,767,281 B2 7/2004 McKee
9,062,454 B1 * 6/2015 Borgman ..... F24F 7/06
2006/0240762 A1 10/2006 Railkar et al.
2012/0052792 A1 3/2012 Sinur et al.
2013/0247480 A1 * 9/2013 Ridgway ..... E04D 13/178 52/95

OTHER PUBLICATIONS

Mar-flex: Waterproofing and Basement Producs for Lower Level Living: Vortex Telescopic Vents, Feb. 26, 2013 http://1235303.sites.myregisteredsite.com/residential/crawl_space_vents.php.*

* cited by examiner

*Primary Examiner* — Steven B McAllister
*Assistant Examiner* — Elizabeth M. May
(74) *Attorney, Agent, or Firm* — Medley, Behrens and Lewis, LLC; Lorri W. Cooper

(57) ABSTRACT

A soffit vent is provided. The soffit vent includes a housing having a front portion and a rear portion forming an interior volume. The housing is configured to be placed against a soffit of a house and provides air communication from an exhaust fan via an air duct to the ambient environment. The front portion includes an air outlet port and the rear portion includes an air inlet port that is attached to the air duct to provide air communication to the ambient environment. The front portion is telescopically received by the rear portion to form an adjustable length that allows a user to extend the adjustable length beyond a far edge of the soffit. In this way, warm, moist air is dispersed away from the soffit by the air outlet port in order to prevent the same air from being drawn back in.

7 Claims, 4 Drawing Sheets

SOFFIT VENT

CROSS REFERENCE TO RELATED APPLICATION

This application claims the benefit of U.S. Provisional Application No. 62/011,748 filed on Jun. 13, 2014. The above identified patent application is herein incorporated by reference in its entirety to provide continuity of disclosure.

BACKGROUND OF THE INVENTION

Field of the Invention

The present invention relates to bathroom ventilation. More specifically, the present invention pertains to an improved soffit vent that allows moist air to be dispersed outdoors.

A bathroom exhaust fan draws in airborne moisture before it can cause damage or harm. During a bath or shower, if not removed promptly, the moisture can condense on bathroom floors and make them dangerously slippery. Airborne moisture condensing on the walls encourages the growth of bacteria, mold and mildew that can cause bathroom odors and pose a potential health risk. In addition, long-term exposure to excess moisture and humidity can crack and peel paint and wallpaper, ruin wallboard, warp doors, and rust cabinets and fixtures.

Generally, a bathroom exhaust fan always exhausts to the outdoors. A typical venting option includes running a duct up through the roof or down through the soffit. However, a typical soffit vent disperses the warm, moist air down through the soffit area, and then is drawn back into the attic due to the ambient air flow. Thereby, introducing the potential of mold in the attic and causing more harm than good. In the alternative, venting through a roof is also contrary to a homeowner's needs. Venting through a roof will cause condensation to run back down into the fan housing, causing it to rust, and wetting surrounding insulation and ceiling finishes. Therefore, there exists a need for an improved soffit vent that prevents warm, moist air from being drawn back through the soffit vent.

The present invention provides a soffit vent that extends beyond the soffit of a house and disperses air substantially upwardly to prevent warm, moist air from being drawn back through. The soffit vent includes a housing having a front portion and a rear portion forming an interior volume. The housing is configured to be placed against a soffit of a house and provides air communication from an exhaust fan via an air duct to the ambient environment. The front portion includes an air outlet port and the rear portion includes an air inlet port that is attached to an existing air duct to provide air communication to the ambient environment. The front portion is telescopically received by the rear portion to form an adjustable length that allows a user to extend the adjustable length beyond a far edge of the soffit. In this way, warm, moist air dispersed from the exhaust fan out the air outlet port is dispersed away from the soffit to prevent the same air from being drawn back in.

SUMMARY OF THE INVENTION

In view of the foregoing disadvantages inherent in the known types of soffit vents now present in the prior art, the present invention provides a new and improved soffit vent wherein the same can be utilized for preventing warm, moist air from being drawn back through the same.

It is therefore an object of the invention to provide a new and improved soffit vent that has all of the advantages of the prior art and none of the disadvantages.

Another object of the present invention is to provide a new and improved soffit vent that includes a housing having a front portion and a rear portion forming an interior volume therethrough.

A further object of the present invention is to provide a new and improved soffit vent, wherein said interior volume is configured to provide air communication with an exhaust fan via an air duct to the ambient environment.

Yet another object of the present invention is to provide a new and improved soffit vent wherein said front portion is telescopically received by said rear portion to form an adjustable length that allows for the housing to be extended beyond the soffit of a house.

Still yet another object of the present invention is to provide a new and improved soffit vent, wherein said rear portion includes an air inlet portion and said front portion includes an air outlet port.

A further object of the present invention is to provide a new and improved soffit vent, wherein said rear portion and said front portion are substantially curved upwardly to disperse warm, moist air and prevent the same from being drawn back in.

Still yet another object of the present invention is to provide a new and improved soffit vent wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
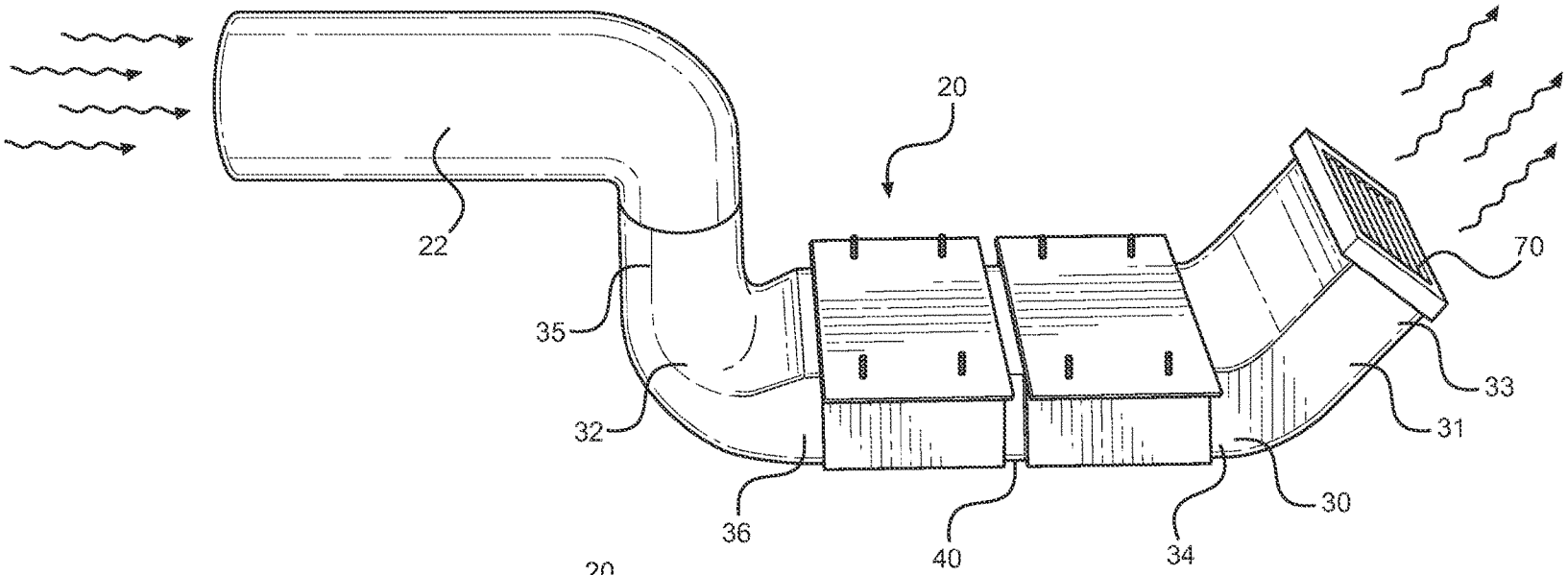
FIG. 1 shows a side perspective of the present invention in the retracted configuration.

References are made herein to the attached drawings. Like reference numerals are used throughout the drawings to depict like or similar elements of the soffit vent. For the purposes of presenting a brief and clear description of the present invention, the preferred embodiment will be discussed as used to disperse warm, moist air therethrough and prevent the same warm, moist air from being drawn back through. The figures are intended for representative purposes only and should not be considered to be limiting in any respect.

Figure 2:
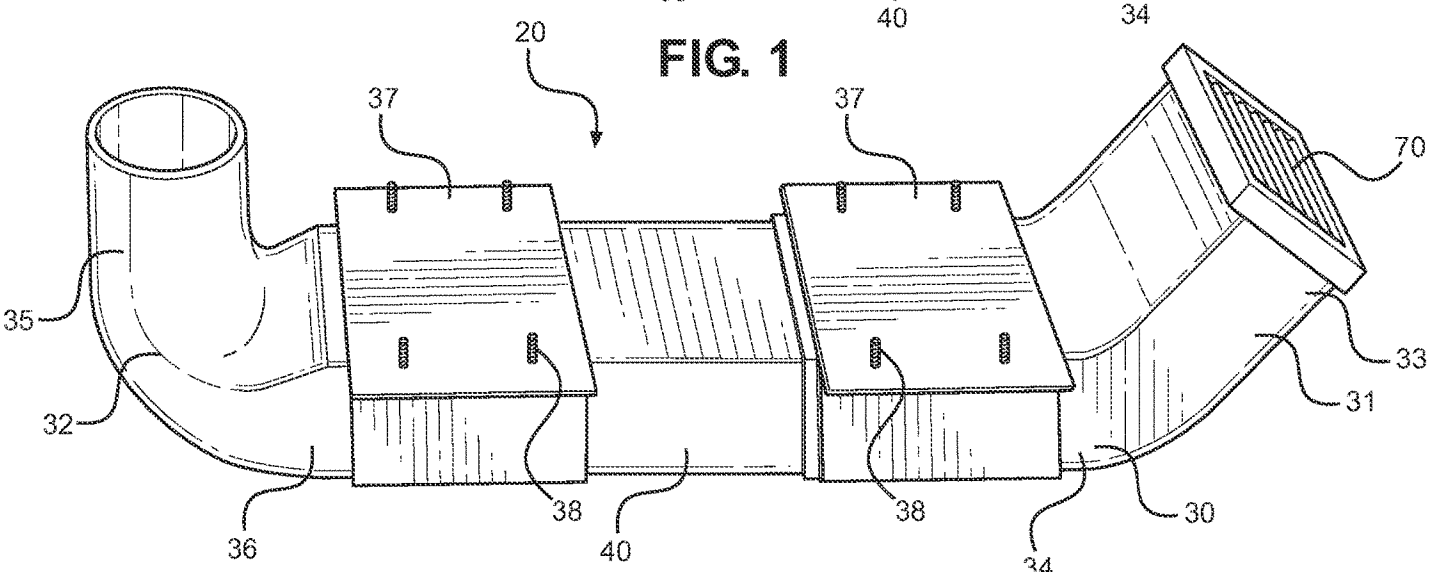
FIG. 2 shows a side perspective of the present invention in the extended configuration.

Referring now to FIGS. 1 and 2, there are shown a pair of side perspective views of the soffit vent 20. The soffit vent 20 is configured to be connected to a bathroom exhaust fan via an air duct that allows the bathroom exhaust fan to dispose of warm, moist air outside of the house, thereby preventing mold and other potential harm. Conventionally, soffit vents dispose warm, moist air downwardly through the soffit. However, the soffit vent 20 as provided in the present disclosure is configured to extend underneath and beyond the soffit to disperse air away and upwardly from the soffit and roof overhang. In this way, the soffit vent 20 prevents any warm, moist air from being drawn back through the soffit vent, which may cause molding and other potential damage. For the purposes of the present disclosure, the soffit references the material that connects the roof overhang and the side of a house.

Although in the present disclosure, the soffit vent 20 is configured to disperse warm, moist air from a bathroom exhaust fan via an air duct 22 to the ambient environment, it is contemplated that the soffit vent 20 can easily be connected other similar types of ventilation systems that require the disposal of air to the outdoors. The soffit vent 20 is a tubular construction comprising a housing 30 having a front portion 31 and a rear portion 32 forming an interior volume. Both the front portion 31 and the rear portion 32 are substantially L-shaped and configured to be connected to one another to form substantially a U-shape. The front portion 31 includes a first end 33 and a second end 34, wherein the first end 33 includes an air outlet port 70 and the second end 34 is configured to be telescopically received by the rear portion 32.

The rear portion 32 comprises a proximal end 35 and a distal end 36, wherein the proximal end 35 includes an air inlet port that is attached to an air duct 22 that allows for air communication between the housing 30 and the bathroom vent. The distal end 36 is configured to telescopically receive the second end 34 of the front portion 31. The distal end 36 and the second end 34 form an adjustable length 40 of the housing 30. As illustrated in FIGS. 1 and 2, FIG. 1 shows the adjustable length 40 in a retracted configuration, while FIG. 2 shows the adjustable length 40 in an extended configuration. In this way, the housing 30 is particularly advantageous to users as it allows the first end 33 to extend beyond a variety of a variety of different soffits and roof overhangs; thereby allowing the housing 30 to disperse warm and moist air to the ambient environment without letting the air to be drawn back in.

Preferably, the housing 30 is substantially U-shaped, wherein the first end 33 of the front portion 31 and the proximal end 35 of the rear portion 32 are curved upwardly at an angle in relation to the flat, adjustable length 40 of the housing 30. In the illustrated embodiment, the first end 33 is curved upwardly in relation to the adjustable length 40 of the housing 30, while the proximal end 35 is substantially curved upwardly and perpendicularly in relation to the adjustable length 40 of the housing 30. The adjustable length 40 of the housing 30 is placed flush against the soffit, wherein the first end 33 extends further than the soffit and the roof overhang, wherein warm, moist air is dispersed through the air outlet port in an upward direction. In this manner, the warm, moist air dispersed therethrough is prevented from being drawn back through and causing potential harm and damage.

It is not desired at this time to limit the exact angle that the first end 33 and the proximal end 35 extend upwardly in relation to the length of the housing. Rather, it is desired to disclose and claim a functional housing 30 for obtaining the results and the advantages described herein. It is contemplated that the angle is readily discernible to one of ordinary skill with the present disclosure before them and these modifications and variations are deemed to be within the scope of the invention embodiments described herein.

In some preferred embodiments, like the illustrated embodiment, the distal end 36 and the second end 34 each further comprise a plate 37. As illustrated, the plate 37 is rectangular in shape, however it is contemplated that the size and shape of the plate 37 are alternatively constructed in other embodiments. The plates 37 include at least one fastener 38 that allows for the length of the housing 30 to be removably fastened to the soffit of a home. The fastener 38 illustrated includes threaded elements, such as a screw, however, other fasteners 38 are suitable to removably fasten the plate 37 to the soffit. In addition, it is preferable that each plate 37 is unitary in structure with the distal end 36 or the second end 34, however, in alternative embodiments the plate 37 may be separate from the distal end 36 and the second end 34. In these alternative embodiments, each plate 37 further comprises a fastener that attaches the plate 37 thereon.

Figure 3:
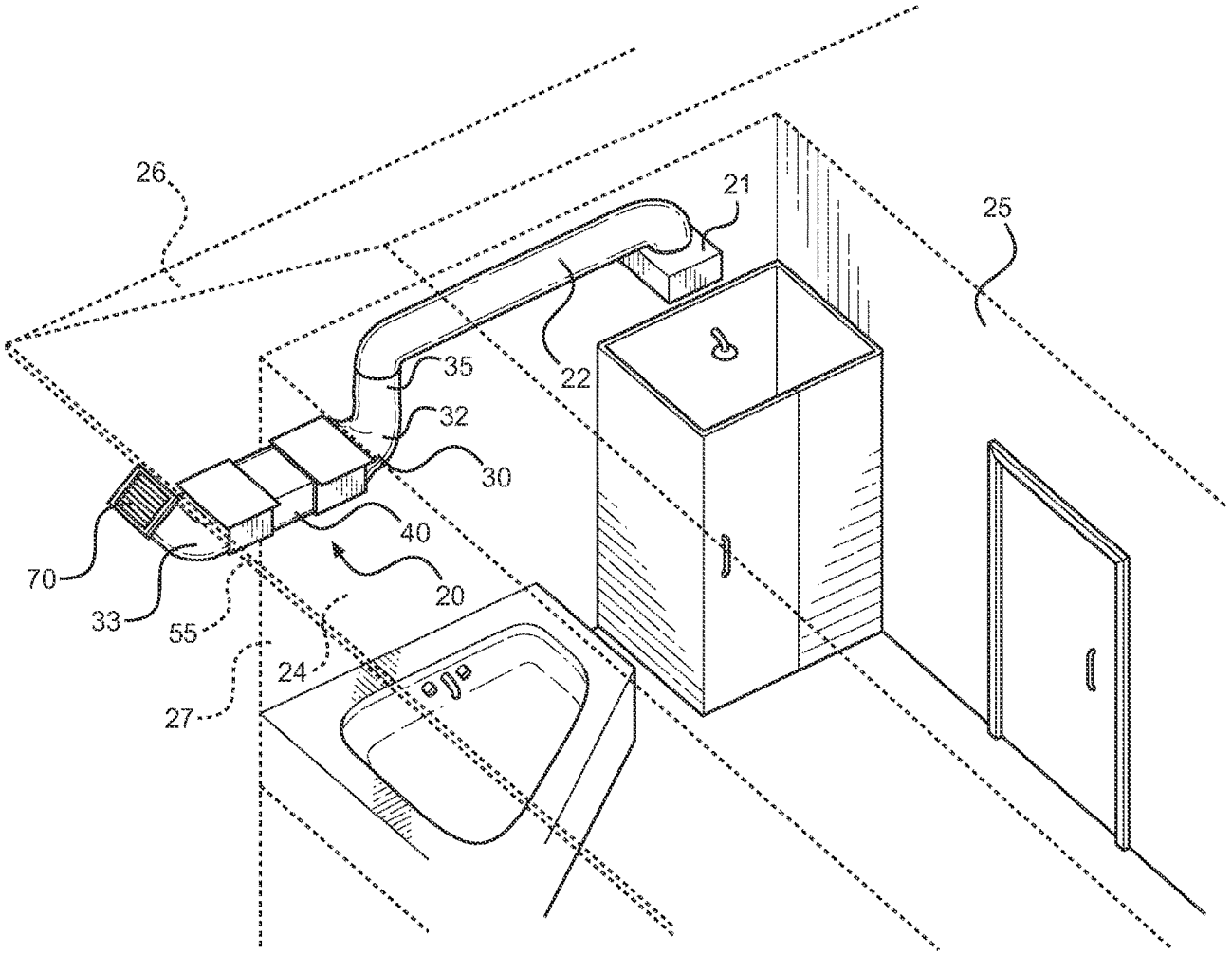
FIG. 3 shows a transparent overhead perspective of the present invention.
Figure 4:
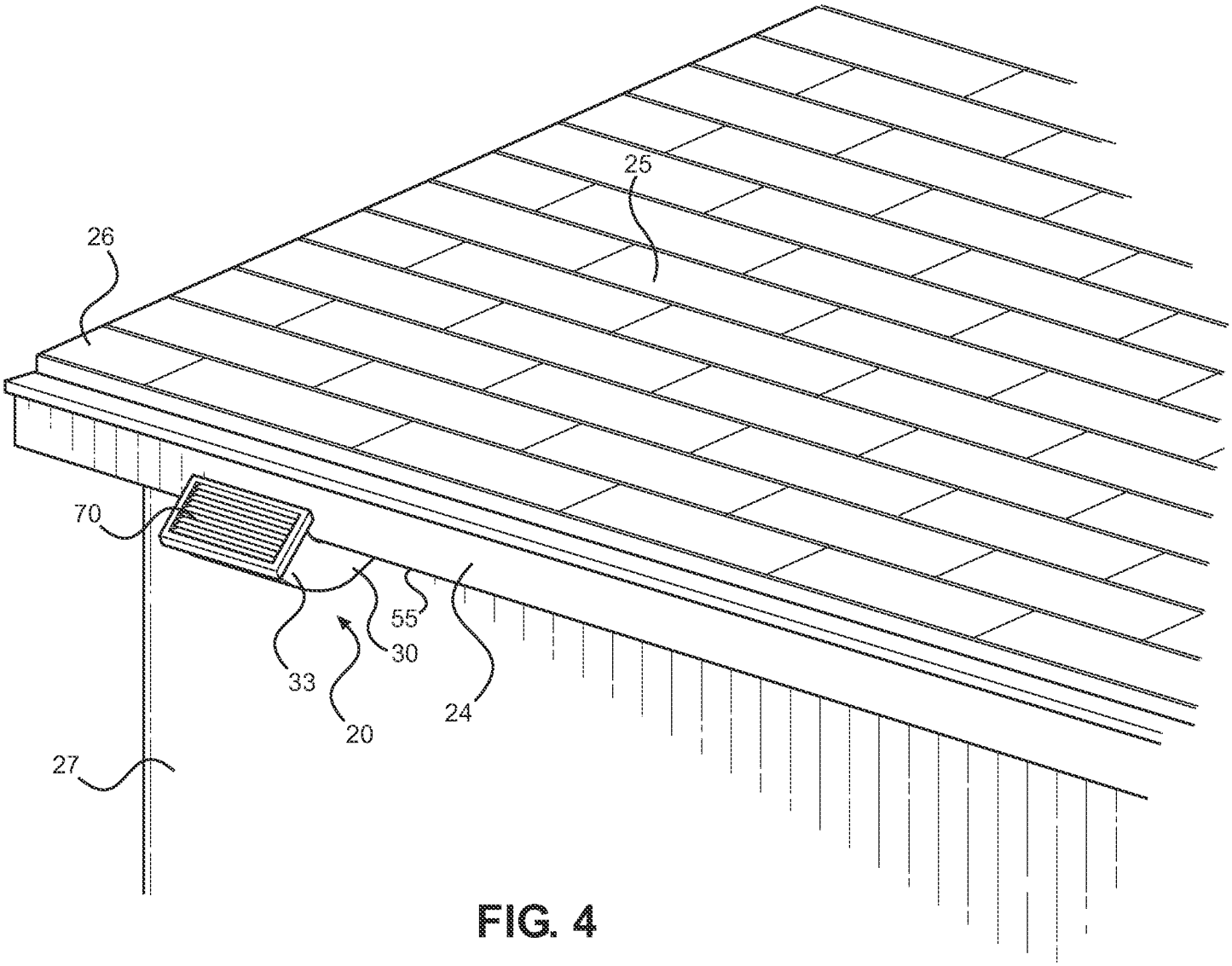
FIG. 4 shows a side perspective of the present invention.

Referring now to FIGS. 3 and 4 there are shown a transparent overhead perspective view of the soffit vent 20 and a side perspective view of the soffit vent 20. The soffit vent 20 is substantially positioned outside a house 25 underneath a soffit 24. It is contemplated that those of ordinary skill in the art will easily determine the portion of the soffit vent 20 to be disposed on the interior of the house 25, if at all. In the illustrated embodiment, the proximal end 35 is configured to be attached to an air duct 22 within the house 25. The air duct 22 provides an air pathway between the interior volume of the soffit vent 20 and the bathroom exhaust fan 21. The rear portion 32 of the soffit vent 20 extends through a side 27 of the house 25 with the first end 33 extended outwardly in relation to the side 27 of the house. Preferably, the proximal end 35 is circular in shape which allows a circular air duct to be attached thereto, however, other alternative embodiments are constructed of other sizes and shapes to correspond with different types of air ducts. Warm, moist air is forced through the interior volume of the soffit vent 20 from the proximal end 35 to the first end 33, where the warm, moist air is dispersed through the air outlet port 70 on the first end 33.

Preferably, the adjustable length 40 of the housing 30 and the first end 33 having the air outlet port are rectangular in shape. In this way, the adjustable length 40 of the housing 30 can be placed against and removably attached to the soffit 24 of a house. However, in other embodiments, it is contemplated that the adjustable length 40, the first end 33 and the air outlet port 70 are other sizes and shapes that still allow for the housing 30 to be removably attached to the soffit 24 of the house. It is likewise contemplated that the soffit vent 20 is composed of thermoplastic or thermoset material, however other alternative materials are suitably used to construct the soffit vent 20.

It is important to note that the adjustable length 40 allows the housing 30 to be extended beyond a far edge 55 of the soffit 24 of the house 25. In this way, the first end 33 can be positioned around the far edge 55 of the soffit 24 to disperse warm, moist air forced therethrough upwardly away from the soffit 24 and the roof overhang 26 of the house 25. This is particularly advantageous because this configuration prevents warm, moist air from being drawn back through as done by conventionally soffit vents that release air downwardly from the surface of the soffit.

Figure 5:
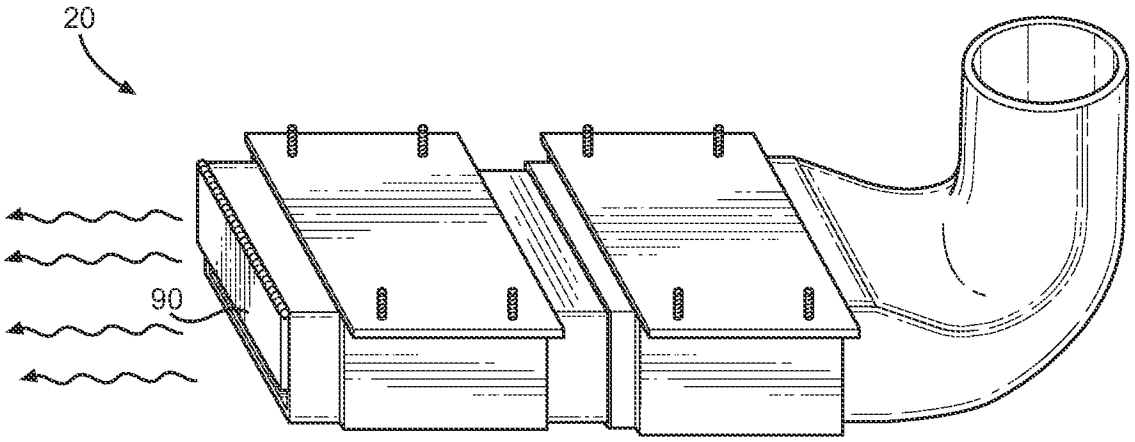
FIG. 5 shows a side perspective of a second preferred embodiment of the present invention.
Figure 6:
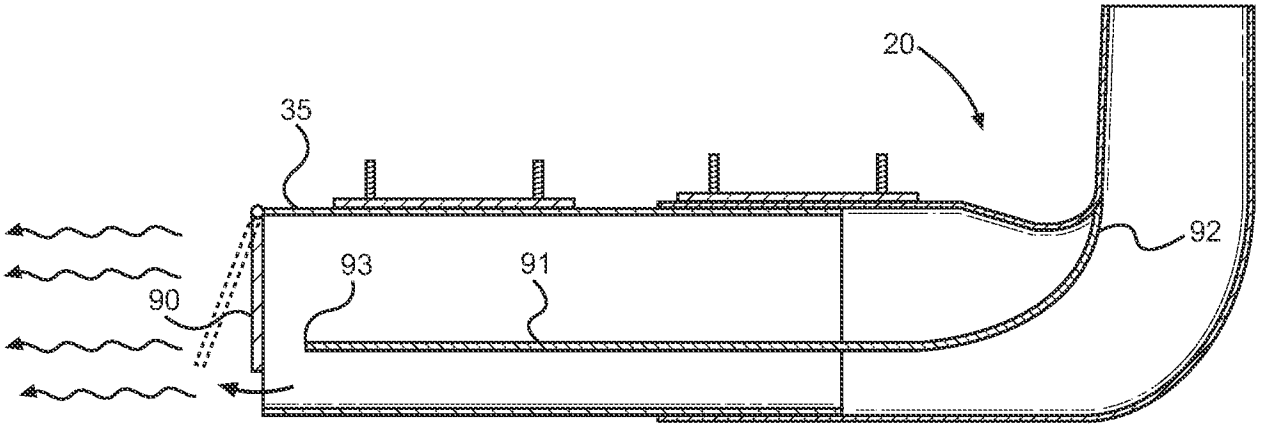
FIG. 6 shows a cross sectional view of the second preferred embodiment of the present invention.

Referring now to FIGS. 5 and 6, there are shown a side perspective and a cross-sectional view of a second preferred embodiment of the soffit vent 20. The soffit vent includes a substantially L-shaped housing having a front portion and a rear portion forming an interior volume. The front portion includes a first end and a second end, wherein the first end includes an air inlet port and the second end is configured to telescopically receive the rear portion. The rear portion comprises a proximal end and a distal end, wherein the proximal end includes a hinged air outlet flap 90. The first end is configured to be attached to the air duct of a bathroom, wherein warm, moist air from a bathroom exhaust fan pivots the hinged air outlet flap 90 to provide air communication from the air duct to the ambient environment. Preferably, the hinged air outlet flap 90 is sized to provide space between the hinged air outlet flap 90 and a lower side of the interior volume as to allow for the hinged air outlet flap 90 to actuate.

The interior volume also includes a curved reducer sheet 91 having a first end 92 and a second end 93 configured to diminish the size of the interior volume thereby forcing the warm, moist air from the bathroom exhaust fan therethrough. The first end 92 is secured to the front portion, wherein the curved reducer sheet 91 extends through the interior volume of the housing to the rear portion. The hinged air outlet flap 90 is configured to abut against the second end 93 of the curved reducer sheet 91 to prevent ambient air or other debris from flowing inwardly into the interior volume.

The distal end and the second end form an adjustable length of the housing. The distal end and the second end each further comprise the plate. The plates include at least one fastener 38 configured to allow for the length of the housing to be removably fastened to the soffit of a home. As can be readily seen, the illustrated embodiment in FIGS. 5 and 6, is substantially similar to the illustrated embodiment in FIGS. 1-4, except for the hinged air outlet flap 90 and the curved reducer sheet 91. Therefore, elements to the illustrated embodiment in FIGS. 5 and 6 have already been explained in the foregoing paragraphs regarding the embodiment in FIGS. 1-4 and likewise apply to the preferred embodiment of FIGS. 5 and 6.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soffit vent, comprising:

a housing having a front portion telescopically coupled to a rear portion forming an interior volume and an adjustable length;

wherein said front portion includes a first end having an air outlet port and a second end;

wherein said first end is curved substantially upwardly in relation to said second end and said adjustable length of said housing;

wherein said rear portion includes a proximal end having an air inlet port and a distal end;

wherein said proximal end of the rear portion is substantially curved upwardly and perpendicularly in relation to said distal end and said adjustable length of said housing;

wherein said distal end is coupled to telescopically with said second end to form said adjustable length;

wherein said distal end and said second end each include a plate comprising a fastener configured to removably attach said plate flush against a soffit of a house;

said air inlet port is adapted to be removably attached to an air duct connected to an exhaust fan, wherein air is adapted to flow through said housing towards said outlet portion of said housing;

said adjustable length is configured to be attached flush against a soffit of a house and extend beyond a far edge of said soffit of said house;

wherein said air outlet port is configured to substantially curve around said far edge of said soffit to disperse air therefrom.

2. The soffit vent of claim 1, wherein said fastener comprises a screw.

3. A soffit vent, comprising:

a housing having a front portion telescopically coupled to a rear portion forming an interior volume and an adjustable length;

wherein said front portion includes a first end having an air outlet port and a second end;

wherein said rear portion includes a proximal end having an air inlet port and a distal end;

wherein said front portion including a hinged air outlet flap positioned over the air outlet port;

wherein said housing includes one or more plates comprising a fastener configured to removably attach said one or more plates flush against a soffit of a house to couple the housing to the house, with the housing extending through a vertical wall of the house directly under the soffit of the house;

wherein said air inlet port is configured to be removably attached to an air duct connected to an air exhaust fan;

wherein said hinged air outlet flap is adapted to provide air communication between said air duct connected to said air exhaust fan and an ambient environment;

wherein said hinged air outlet flap is configured to extend beyond a far edge of a soffit to disperse air therefrom;

wherein said housing is configured to be attached flush against said soffit of said house and extend beyond a far edge of said soffit of said house.

4. The soffit vent of claim 3, wherein said fastener comprises a screw.

5. The soffit vent of claim 3, wherein said adjustable length is rectangular in shape.

6. The soffit vent of claim 3, wherein said hinged air outlet flap is rectangular in shape.

7. The soffit vent of claim 3, further comprising a curved reducer sheet extending through said interior volume of said housing, said reducer sheet including a first end and a second end, said first end secured to said rear portion, said second end abutting an inner side of said hinged air outlet flap to serve as a stop for the rotation of the hinged air outlet flap inwardly to deter the hinged air outlet flap from over-rotating inwardly, wherein said reducer sheet assists in increasing the velocity of the airflow from the first end to push air away from the house.

* * * * *